United States Patent [19]

Wigdahl

[11] 4,168,661

[45] Sep. 25, 1979

[54] ARTICLE CRUSHER

[76] Inventor: Arthur G. Wigdahl, 168 S. Leonard St., West Salem, Wis. 54669

[21] Appl. No.: 925,781

[22] Filed: Jul. 18, 1978

[51] Int. Cl.[2] ..... B30B 9/32; B30B 15/32

[52] U.S. Cl. ..... 100/218; 100/DIG. 2; 100/245; 100/289; 100/293

[58] Field of Search ..... 100/DIG. 2, 293, 295, 100/289, 245, 218, 240

[56] References Cited

U.S. PATENT DOCUMENTS

| | | | |
|---|---|---|---|
| 3,009,414 | 11/1961 | Griemert | 100/DIG. 2 |
| 3,204,550 | 9/1965 | Swiderski | 100/289 X |
| 4,062,283 | 12/1977 | Kaminski | 100/218 |
| 4,133,261 | 1/1979 | Belfils | 100/DIG. 2 |

*Primary Examiner*—Billy J. Wilhite

*Attorney, Agent, or Firm*—B. P. Fishburne, Jr.

[57] ABSTRACT

An article crusher comprised of a base plate support having an upstanding member supporting a pivoted lever with a platen carried thereon adapted to be moved within a cylinder mounted on the support plate to crush an article or the like positioned therein, with said cylinder being shaped to facilitate the insertion and removal of the article.

4 Claims, 6 Drawing Figures

FIG.1
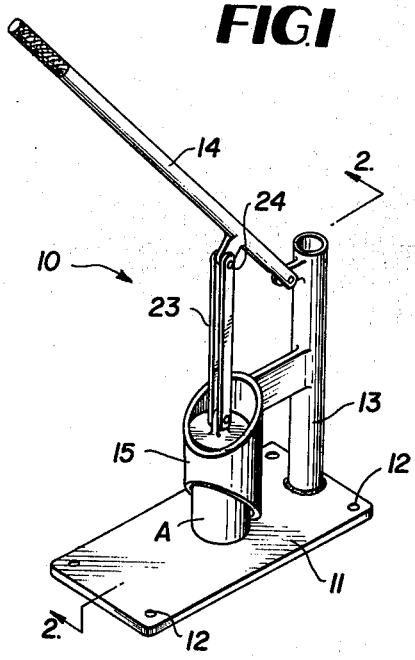
FIG.2
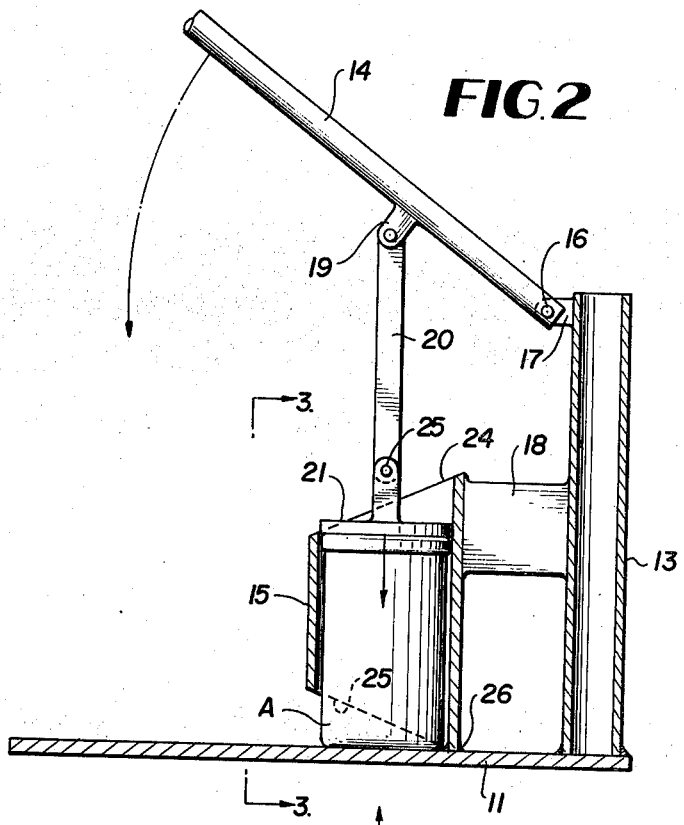
FIG.3
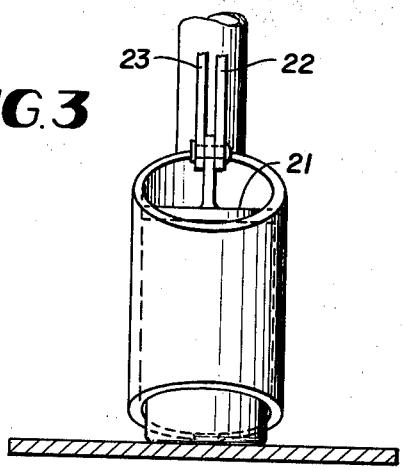
FIG.4
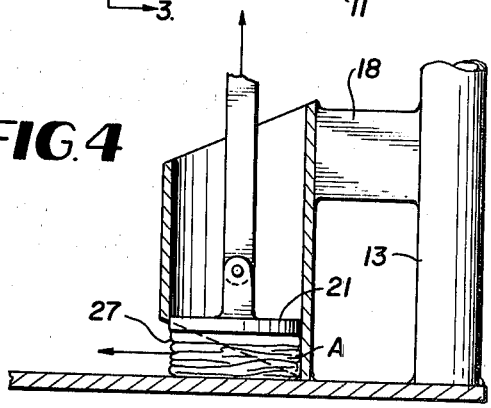
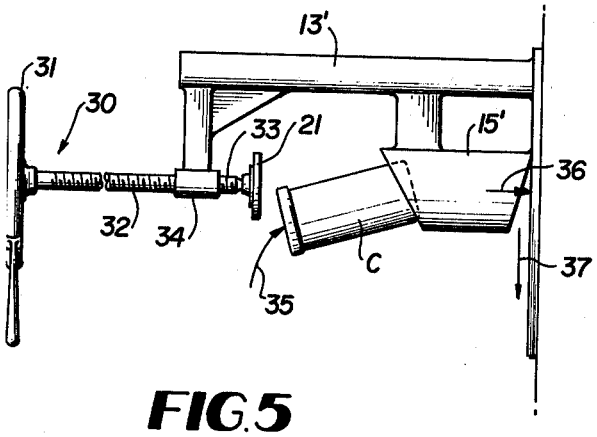
FIG.5
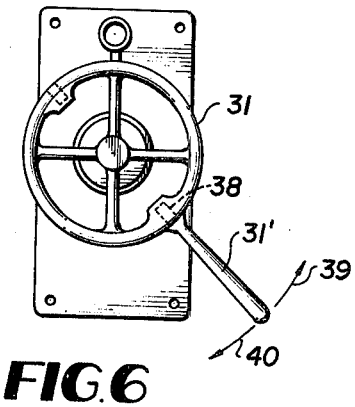
FIG.6

ARTICLE CRUSHER

BACKGROUND OF THE INVENTION

The invention relates to a device for crushing articles and especially cans.

The prior art is aware of article crushing devices generally analagous to be present invention and is typified by U.S. Pat. No. 3,009,414. This patent shows a support for an article to be crushed by a pivotally mounted platen engaging the article under pressure.

SUMMARY OF THE INVENTION

The present article crushing device is comprised of a support, which can be mounted on a surface and while a vertical surface is preferred, the same will function notwithstanding the disposition of the same, having a lever pivotally secured thereon carrying a platen which is adapted to engage an article maintained on the support by a cylindrical housing.

The device can be economically fabricated and assembled due to its simplicity and is beneficial to its user in that it compacts articles to facilitate disposition thereof, such as for trash purposes or for the collection of metals such as aluminum for reuse.

BRIEF DESCRIPTION OF THE DRAWINGS

FIG. 1 is a perspective view of the article crushing device;

FIG. 2 is a sectional view of FIG. 1 taken along lines 2—2 thereof;

FIG. 3 is a front view of the device looking along the lines 3—3 of FIG. 2;

FIG. 4 is an enlarged view showing an article, being crushed between the platen and the base;

FIG. 5 shows a modification of the device shown in FIG. 1, and

FIG. 6 is a top view of the device of FIG. 5.

DETAILED DESCRIPTION

Referring to FIG. 1 the article crushing device is depicted as at 10 and is comprised of a planar base support 11 having openings 12 disposed on the top surface thereof for mounting the plate on any surface as desired. Extending upwardly from the plate 11 is a vertical support member 13 positioned at one edge thereof and is utilized to support a lever 14 and a cylinder 15. The lever 14 is pivoted at 16 to a tab 17 extending outwardly of the tube 13 and in direct alignment with a larger tab 18 which supports the cylinder 15. The tabs 17 and 18 are comprised of metal blocks welded or otherwise secured to the tube 13 as desired.

As clearly seen in FIG. 2 the lever 14 is provided with a depending tab 19 having an arm 20 pivotally secured thereto and a platen 21 pivotally disposed at the lower end of the arm 20.

As seen in FIGS. 1 and 3 the arm 20 is comprised of two spaced links 22, 23 connected by the bolt 24 to the tab 19 while a bolt 25 supports the platen 21 at its lower end.

The cylinder 15 is disposed below and in alignment with the platen 21 and is comprised of a sleeve having portions 24, 25 cut at an angle whereby the front wall of the sleeve is of a smaller length than the rear wall thereof. This feature permits the easy introduction and removal of the compacted article as will be seen more clearly hereinafter. The rear portion of the sleeve 15 is welded as at 26 to the base plate 11 to add rigidity to the same.

In use the article crusher of this device is secured to a surface by securing means positioned in the openings 12, 12 whereby accessibility can be had to the lever and the cylinder. To crush an article the platen 21 is moved away from the cylinder 15 by raising the lever 14 in an upward direction and thereafter the article A is disposed within the sleeve 15 and the lever is thereafter moved downwardly whereby the platen 21 will be forced into engagement with the article until the same is compressed to the state as shown in FIG. 4 at 27. The lever and platen are thereafter moved upwardly to permit the user to grasp the same due to the cutaway portion 25 and remove the same. As is apparent the crushed article will fall by its own weight when the base support 11 is mounted on a vertical surface thereby obviating the user's need to grasp the article.

FIGS. 5 and 6 disclose another embodiment of the basic device wherein the parts thereof which are common thereto are designated by prime numbers while the differing part, that is, the handle is shown at 30 and comprises a wheel actuating member 31 mounted on a shaft 32 having a threaded portion 33 cooperating with a threaded member 34 supported by the upstanding member 13' whereby upon turning the handle 31 the platen 21 can be advanced toward and away from the cylinder 15' to effect the crushing of the article. As is clearly seen, a can-like member C is positioned within the sleeve 15' in the direction of the arrow 35, 36 and is removed as at 37 after being crushed. Additionally, a lug-type actuator 31' can be threaded as at 38 into the wheel 31 to facilitate the rotation thereof in a direction depicted by the arrows 39, 40.

What is claimed is:

1. An article crusher comprising a base means, a support member secured to and extending away from the base means, a cylinder having its axis arranged substantially perpendicular to the base means and spaced from said support member and being connected fixedly thereto, a movable platen adapted to be driven axially in said cylinder whereby an article therein can be crushed between the platen and the base means, a movable driver for the platen connected thereto and connected with said support member, and said cylinder having a tapered end face in opposing relation to said base means whereby a crushed article can be discharged from said cylinder in the passage between said tapered end face and base means.

2. An article crusher as defined in claim 1, and said movable driver comprising an arm pivotally connected to said support member in spaced relation to the base means and said cylinder, and a link pivotally interconnecting said arm and said plate.

3. An article crusher as defined in claim 1, and said driver comprising a rotary screw shaft on said support member and being coaxial with said cylinder.

4. An article crusher as defined in claim 1, and said base means comprising a flat plate, and the tapered end of said cylinder having a terminal fixed to the opposing surface of the flat plate.

* * * * *